US010807765B2

(12) United States Patent
Pheir

(10) Patent No.: US 10,807,765 B2
(45) Date of Patent: Oct. 20, 2020

(54) MULTI-COMPARTMENT ROLL-UP CONTAINER AND CAP

(71) Applicant: Hirshol H. Pheir, St. Thomas, VI (US)

(72) Inventor: Hirshol H. Pheir, St. Thomas, VI (US)

( * ) Notice: Subject to any disclaimer, the term of this patent is extended or adjusted under 35 U.S.C. 154(b) by 301 days.

(21) Appl. No.: 15/950,214

(22) Filed: Apr. 11, 2018

(65) Prior Publication Data

US 2019/0315514 A1 Oct. 17, 2019

(51) Int. Cl.
*B65D 21/02* (2006.01)
*B65D 41/04* (2006.01)

(52) U.S. Cl.
CPC ..... *B65D 21/0201* (2013.01); *B65D 41/0492* (2013.01)

(58) Field of Classification Search
CPC ..... B65D 21/0201; B65D 41/0492; B65D 21/0205; B65D 81/3288; B65D 41/18; B65D 41/04; B65D 77/2024
USPC ..... 220/4.27
See application file for complete search history.

(56) References Cited

U.S. PATENT DOCUMENTS

| | | | | |
|---|---|---|---|---|
| 1,035,258 A | | 8/1912 | Stegman | |
| 1,190,196 A | | 7/1916 | Schweinert | |
| 2,207,520 A | * | 7/1940 | Rhody | B65D 51/246 206/229 |
| 2,665,816 A | | 1/1954 | Anft | |
| 2,726,004 A | | 12/1955 | Mcleod | |
| 2,764,309 A | * | 9/1956 | Zelonka | A45C 5/005 220/23.4 |
| 2,845,976 A | | 8/1958 | Miller | |
| D197,862 S | | 3/1964 | Wills et al. | |
| D197,863 S | | 3/1964 | Wills et al. | |

(Continued)

FOREIGN PATENT DOCUMENTS

| | | |
|---|---|---|
| DE | 102 07 763 A1 | 9/2003 |
| FR | 1 503 901 | 12/1967 |

(Continued)

OTHER PUBLICATIONS

International Search Report and Written Opinion, dated Sep. 30, 2015, pp. 1-11.

(Continued)

*Primary Examiner* — Ernesto A Grano
(74) *Attorney, Agent, or Firm* — Gibb & Riley, LLC

(57) ABSTRACT

Container/cap structures include pie-piece shaped individual containers shaped to fit together, and pie-piece shaped individual caps that are attachable to each of the individual containers. Each of the individual containers is connected to at least one of the other container by connections, and these connections between the individual containers permit the individual containers to be rolled together to form a complete multi-compartment container. Each of the individual caps includes a projection and a recess positioned to join corresponding projections and recesses of adjacent individual caps. The projection and recess of the individual caps connect the individual caps together to form a complete cap when the individual containers are rolled together. The complete cap is capable of being unscrewed from the complete container to simultaneously separate all of the individual caps that form the complete cap from all of the individual containers that form the complete multi-compartment container.

20 Claims, 11 Drawing Sheets

(56) References Cited

U.S. PATENT DOCUMENTS 3,245,528 A 4/1966 Holley
3,257,154 A 6/1966 Lewis
3,295,710 A 1/1967 Marchant
3,385,465 A * 5/1968 Bliss ..... A47J 27/122 220/23.4
3,386,607 A 6/1968 Keene
3,559,866 A 2/1971 Olson, Sr.
3,785,545 A 1/1974 Roussel
3,815,281 A * 6/1974 Kander ..... A63H 33/04 446/77
3,876,112 A * 4/1975 Kramer ..... B65D 1/04 222/132
4,004,501 A 1/1977 Guerrero
4,081,101 A 3/1978 West
4,126,239 A 11/1978 Gehrig et al.
4,139,114 A * 2/1979 Long ..... B65D 63/1009 220/23.4
4,165,812 A * 8/1979 Jennison ..... B65D 21/0204 215/10
4,320,846 A 3/1982 Meyering et al.
4,326,628 A 4/1982 Wood
D279,621 S * 7/1985 Richer ..... D19/75
4,799,590 A 1/1989 Furman
4,890,741 A 1/1990 Edelstein
4,919,293 A * 4/1990 Buckley ..... B65D 1/30 220/23.2
D323,108 S * 1/1992 Green ..... D9/741
D324,121 S 2/1992 Schierlinger
5,101,997 A * 4/1992 Bagwell ..... B65F 1/0066 220/23.4
5,135,823 A 8/1992 Eales
5,156,289 A 10/1992 Goof
5,158,191 A * 10/1992 Douglas ..... B65D 21/0204 206/432
5,310,071 A 5/1994 Rivlin et al.
5,340,550 A * 8/1994 Johnsen ..... A61L 2/26 422/292
5,344,006 A 9/1994 Mazzeo
5,351,815 A 10/1994 Fogle et al.
5,351,816 A 10/1994 Sutherland et al.
D354,909 S * 1/1995 Blanche ..... D7/596
5,381,916 A * 1/1995 Strawder ..... B65D 21/0202 220/212
5,386,928 A * 2/1995 Blette ..... B05C 17/00516 222/136
3,206,897 A 9/1995 Hilker et al.
5,615,765 A 4/1997 Roericht
5,676,253 A 10/1997 Hsu
5,676,274 A 10/1997 Green et al.
5,752,464 A 5/1998 King et al.
5,823,136 A 10/1998 Zarski
5,823,391 A * 10/1998 Klauke ..... B65D 35/22 222/94
D407,306 S 3/1999 Saab
D415,023 S * 10/1999 Snyder ..... D9/747
6,085,908 A 7/2000 Lento
6,244,501 B1 6/2001 Choi
D463,120 S 9/2002 Yoshinaka
D468,535 S 1/2003 McCormack
D489,271 S 5/2004 Soomar
D517,866 S * 3/2006 Burks ..... D7/590
7,258,251 B2 * 8/2007 Johnson ..... A47G 19/183 215/6
D556,321 S 11/2007 Starnes
D570,682 S 6/2008 Erden
7,665,634 B2 2/2010 Pressler
7,699,211 B2 4/2010 Holloway
D618,063 S * 6/2010 Davies ..... D7/596
7,810,667 B2 10/2010 Douglas
8,074,801 B2 12/2011 Slayton
8,267,013 B2 9/2012 Moore
8,338,357 B2 12/2012 Gibis et al.
8,523,469 B2 * 9/2013 Abergel ..... B65D 81/3288 401/18
8,584,899 B2 * 11/2013 Dessaint ..... B29B 11/14 215/40
8,651,271 B1 * 2/2014 Shen ..... B65D 21/0204 206/216
D702,998 S 4/2014 Fugere
D703,403 S * 4/2014 Dey ..... D32/35
8,695,820 B2 * 4/2014 Rabie ..... B65D 81/361 215/252
8,720,723 B2 * 5/2014 Morris ..... E03B 3/03 220/212
D711,254 S 8/2014 Madda
D711,255 S 8/2014 Madda
D724,893 S * 3/2015 Dirks ..... D7/507
D729,577 S * 5/2015 Dirks ..... D7/507
9,084,480 B2 7/2015 Atwood
D735,994 S 8/2015 Mangano
9,199,767 B1 12/2015 Pheir
9,346,585 B2 5/2016 Hendrickson et al.
D760,091 S 6/2016 Pheir
D766,737 S 9/2016 Pheir
D766,739 S 9/2016 Pheir
9,469,455 B2 10/2016 Clough
10,478,716 B1 * 11/2019 Solowiej ..... B65D 3/24
10,562,693 B1 * 2/2020 Ambrezewicz .... B65D 47/0838
2004/0149774 A1 8/2004 Strong
2005/0011853 A1 * 1/2005 Brugger ..... B65D 21/0204 215/10
2005/0098527 A1 * 5/2005 Yates, III ..... B29C 49/0073 215/6
2007/0029275 A1 * 2/2007 Hantman ..... B29C 49/0078 215/6
2007/0114242 A1 * 5/2007 Dodrill ..... B65D 1/0223 222/129
2008/0035636 A1 * 2/2008 Grant ..... B65D 21/0201 220/23.4
2013/0180983 A1 * 7/2013 Krstic ..... B65D 1/0223 220/23.83
2013/0206772 A1 8/2013 Halbherr et al.
2014/0061236 A1 * 3/2014 Dey ..... B65D 21/0201 222/129
2014/0216956 A1 8/2014 Ott
2015/0158632 A1 * 6/2015 Wilhelm ..... B65D 25/04 426/120
2016/0236821 A1 8/2016 Pheir
2017/0081076 A1 3/2017 Meroz

FOREIGN PATENT DOCUMENTS

GB 2 305 162 4/1997
KR 200203011 Y1 11/2000
WO 01/044065 A1 6/2001
WO 2005/110872 A1 11/2005
WO 2017/044992 A1 3/2017

OTHER PUBLICATIONS

U.S. Appl. No. 14/923,36, Office Action Communication dated Apr. 2016, pp. 1-15.

Chained Polyhedral Portion Packs, available Aug. 16, 2011, [online], [site visited Mar. 14, 2018]. Available from Internet, <URL: http://http://beachpackagingdesign.com/boxvox/chained-polyhedral-portion-packs.

Stephanie Sansregret's L'Kit de Survie (via Packaging UQAM), available Feb. 26, 2011, [online], [site visited Mar. 14, 2018]. Available from internet, <URL:http://packaginguqam.blogspot.com/2011/02/lkit-de-survie-stephanie-sansregret.html.

Laurence Gregoire's Chocolat Chaud (via Packaging UQAM) available Jan. 15, 2012, [online], [site visited Mar. 14, 2018]. Available from internet, <URL: http://packaginguqam.blogspot.com/2010/03/chocolat-chaud-laurence-gregoire.html.

Veronica Jarquin's Ludo Pasta, available Nov. 15, 2011, [online], [site visited Mar. 14, 2018]. Available from internet, <URL: https://www.behance.net/gallery/2513781/Ludo-package-design.

International Search Report and Written Opinion, dated Aug. 24, 2017, pp. 1-7.

(56) References Cited

OTHER PUBLICATIONS

International Application No. PCT/US2018/027004, International Search Report and Written Opinion dated Dec. 20, 2018, pp. 1-12.

* cited by examiner

MULTI-COMPARTMENT ROLL-UP CONTAINER AND CAP

BACKGROUND

Systems and methods herein generally relate to watertight and airtight individual containers, and more particularly to individual containers that utilize caps that combine together to form a complete cap.

Ever since the first clay pots were baked in open ovens thousands of years ago, individual containers have taken many different forms, shapes, and sizes. Indeed, watertight and airtight individual containers are indispensable in modern society; however, traditional individual containers generally maintain a single compartment that allows all contents therein to mix. Further, while some multi-compartment individual containers exist, such individual containers keep the different compartments at fixed positions with respect to one another, which can make such individual containers bulky and difficult to package, transport, etc.

SUMMARY

Generally, container/cap structures herein include (among other components) pie-piece shaped individual containers shaped to fit together, and pie-piece shaped individual caps that are attachable to each of the individual containers. Each of the individual containers can have the same size and shape and be connected to at least one of the other individual containers by connections, and these connections between the individual containers permit the individual containers to be rolled together to form a complete multi-compartment container.

Each of the individual caps includes a projection and a recess positioned to join corresponding projections and recesses of adjacent individual caps. The projection and the recess of the individual caps connect the individual caps together to form a complete cap when the individual containers are rolled together.

The complete multi-compartment container and the complete cap can optionally include complementary threading, making the complete cap capable of being unscrewed from the complete container, to simultaneously separate all of the individual caps that form the complete cap from all of the individual containers that form the complete multi-compartment container.

In greater detail, each of the individual caps has a top member and a side member, perpendicular to the top member, that join to form a corner. The upper surface of the top member comes to a point opposite the corner where the side member joins the top member. Further, the top member and the side member form the exterior of the completed cap when the individual containers are rolled together. The side member has a curved surface, such that the side members of the individual caps form a rounded ring when the individual containers are rolled together.

Also, each individual cap can include multiple projections that can be the same or different from one another. Therefore, the projection can be a tab and/or a wing. In some examples, the tab can be a rectangular cuboid or prism, and the wing can be a triangular wing (e.g., delta wing). The number of recesses matches the number of projections and, correspondingly, the recess comprises at least one slot. The slot(s) are shaped to receive and accommodate the tab or the wing. Also, the projection is shaped to press against the walls of the recess when the individual containers are rolled together, preventing the completed cap from unrolling.

Additionally, the individual containers have a container opening and a top edge that defines the container opening. Correspondingly, the individual caps have a bottom surface that contacts the top edge and seals the container opening. These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1:
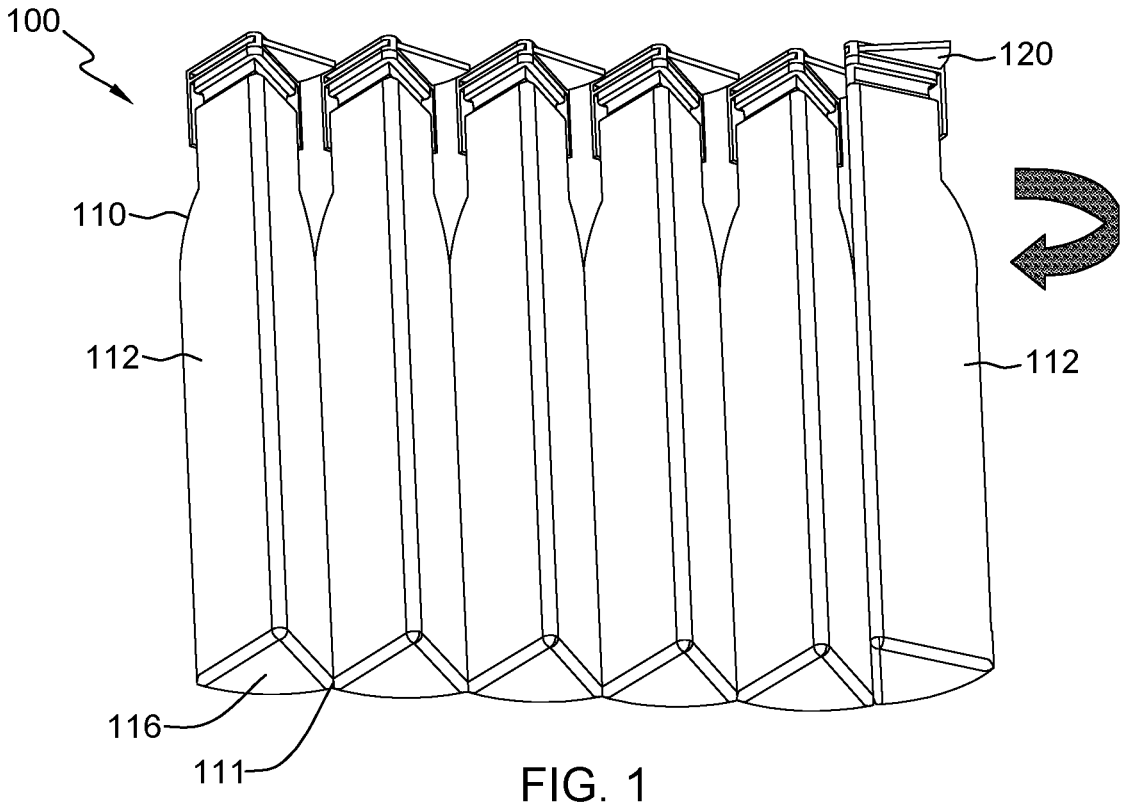
FIGS. 1-6 are perspective drawings illustrating partially rolled devices herein.

As shown in the accompanying drawings (discussed in detail below) various multi-compartment individual containers are disclosed herein. Such individual containers can hold individual premeasured ingredients that are kept separate until needed for use/consumption. When rolled-up, the individual containers form an overall larger container that positions all individual container fill/dispense openings in one location. The individual caps of the rolled-up container connect together by projection/recess connections that click together, and the complete cap formed by the individual caps joined together can be rotated (twisted) open to allow the contents of the individual containers to be poured into a receptacle (glass, pitcher, blender, etc.). Thus, when the individual containers are rolled into a cylindrical shape, the complete cap formed by the individual caps can be rotated, causing all the individual caps to be separated from the tops of all the individual containers. The contents can then be poured through the individual fill/dispense openings of the different individual containers into a pitcher of ice, a blender, a glass, etc., to be used or consumed.

FIGS. 1-6 illustrate different perspective views of an exemplary multi-compartment container structure 100 herein. As shown in FIGS. 1-6, container/cap structures 100 herein include (among other components) pie-piece shaped individual containers 110 shaped as a triangular-shaped tubular body to fit together, and pie-piece shaped individual caps 120 that are attachable to each of the individual containers 110.

Each of the individual containers 110 can have the same size and shape (or can be different sizes/shapes) and be connected to at least one of the other individual containers 110 by connections or joints 111. These connections 111 between the individual containers 110 permit the individual containers 110 to be rolled together to form a complete multi-compartment container 118. Thus, each of the individual containers 110 is joined to immediately adjacent containers of the container structure by joints 111 at wall edges of an exterior wall 114 (of the three walls, in this example). The joints 111 can be integral to (a part of) the individual containers 110, can be the result of the individual containers 110 being bonded to one another using adhesives or heating, can be continuous adhesive sheets (e.g., label 119, shown in FIG. 8) contacting the exterior walls 114 of each of otherwise physically separate individual containers 110, etc. The joints 111 have a greater flexibility relative to the exterior wall 114 (either by being thinner or by being made of a different material) thereby allowing adjacent exterior walls 114 to fold relative to one another around a corresponding joint 111.

Figure 2:
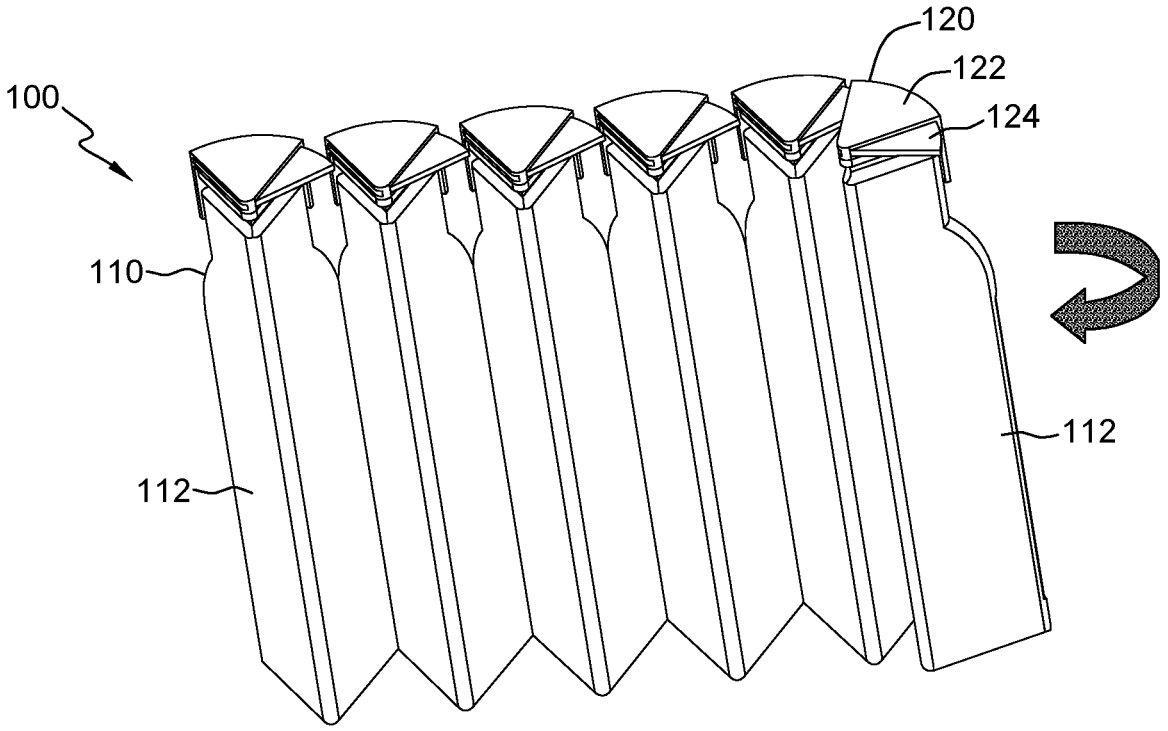
Figure 3:
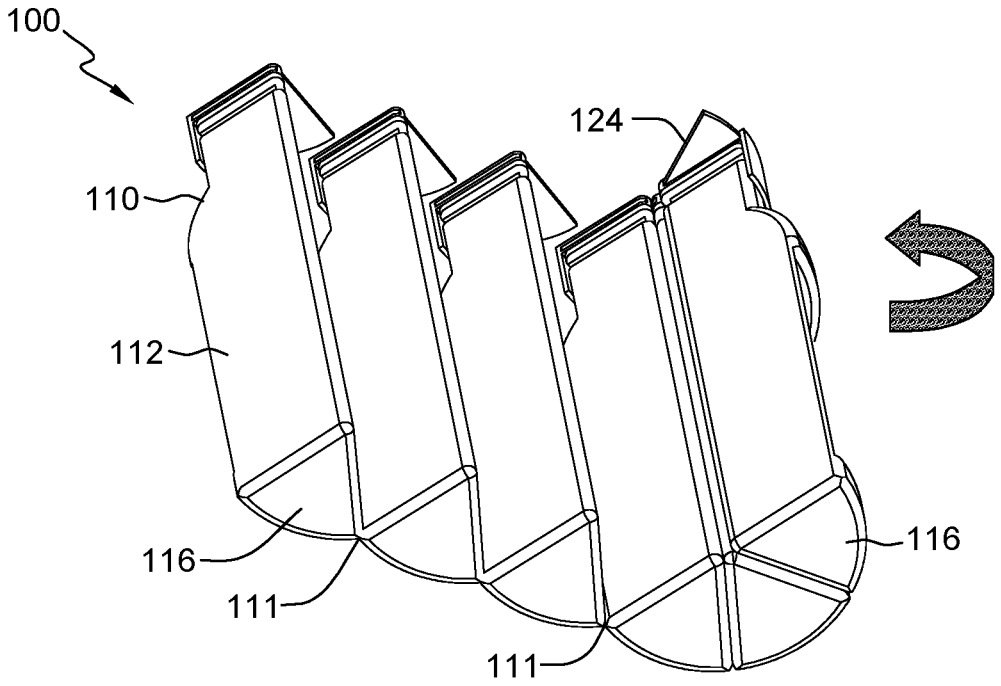
Figure 4:
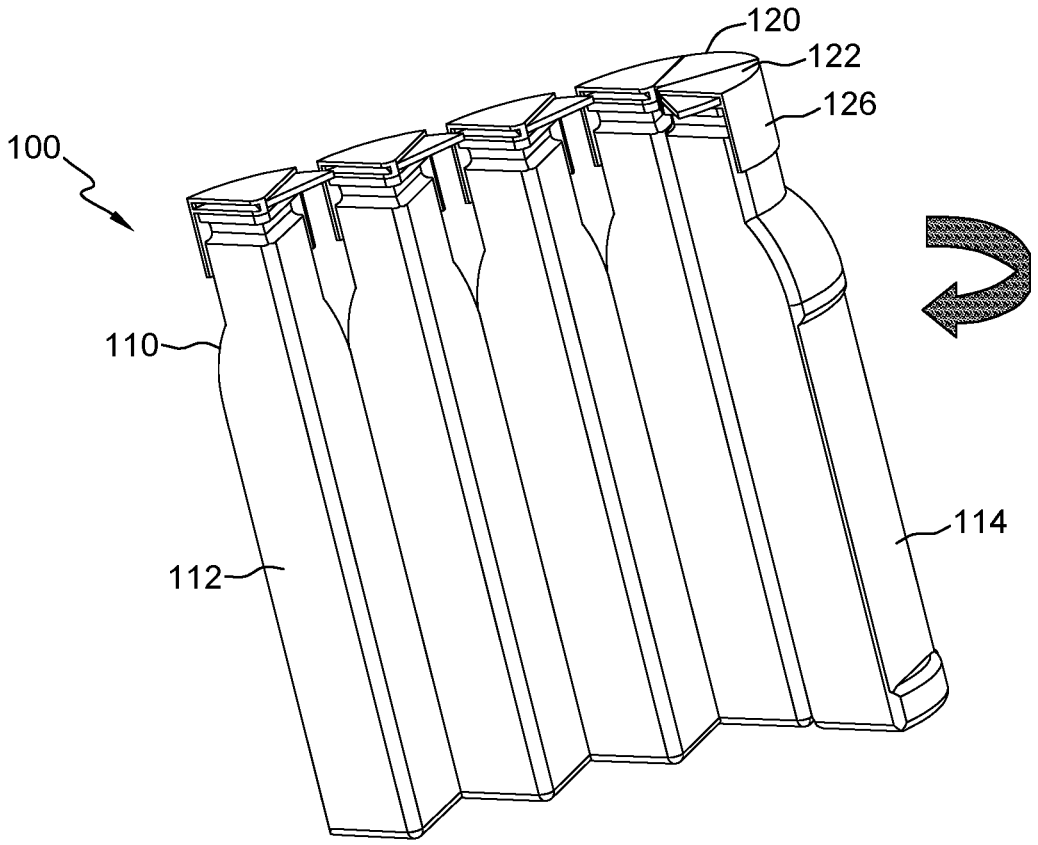
Figure 5:
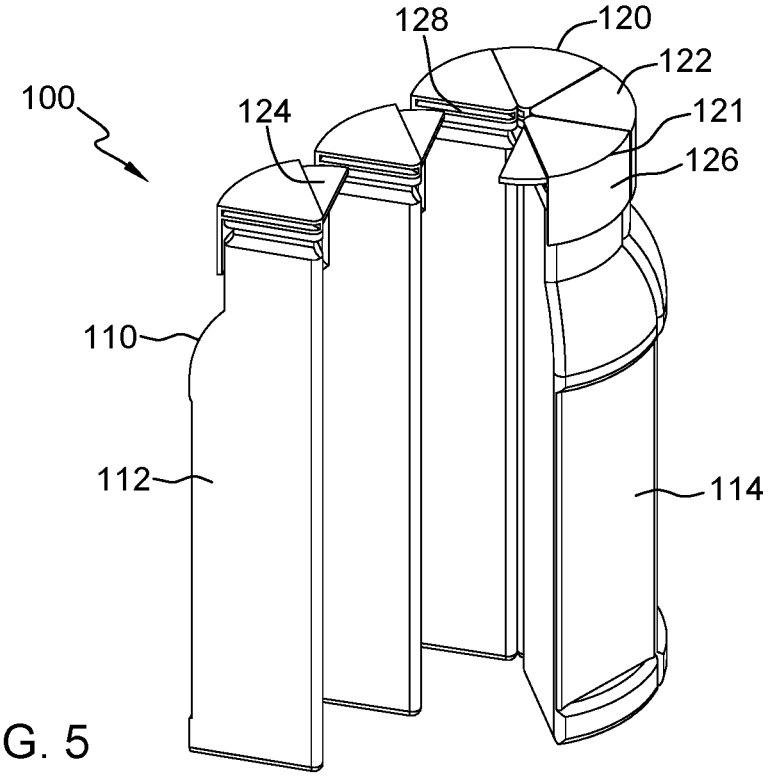
Figure 6:
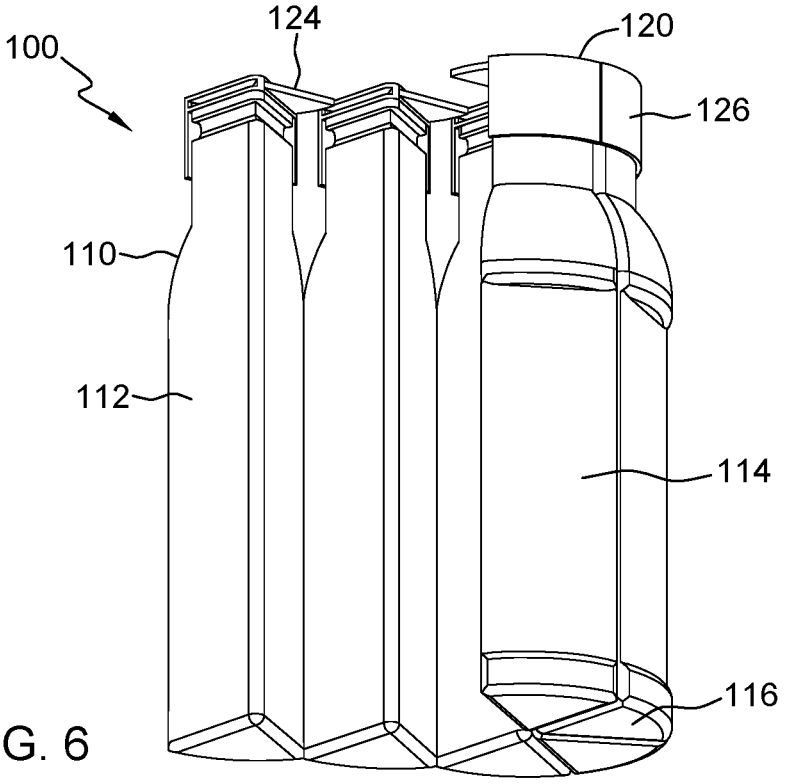
Figure 7:
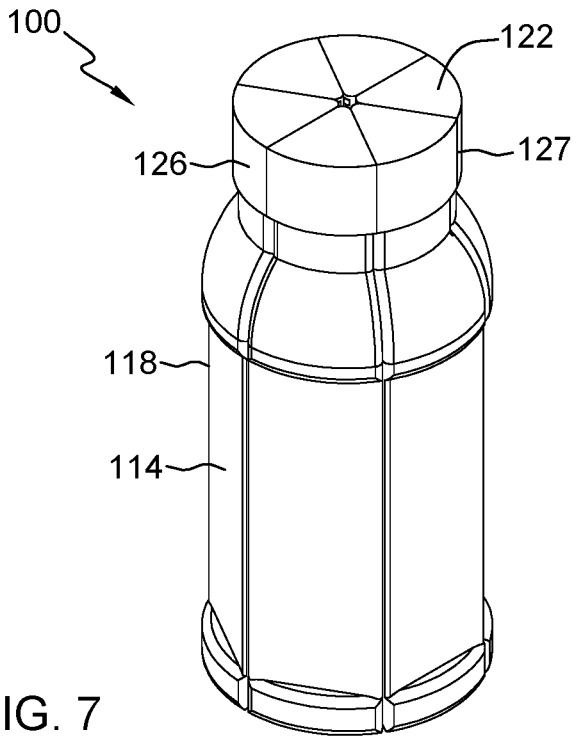
FIGS. 7-8 are perspective drawings illustrating fully rolled devices herein.
Figure 8:
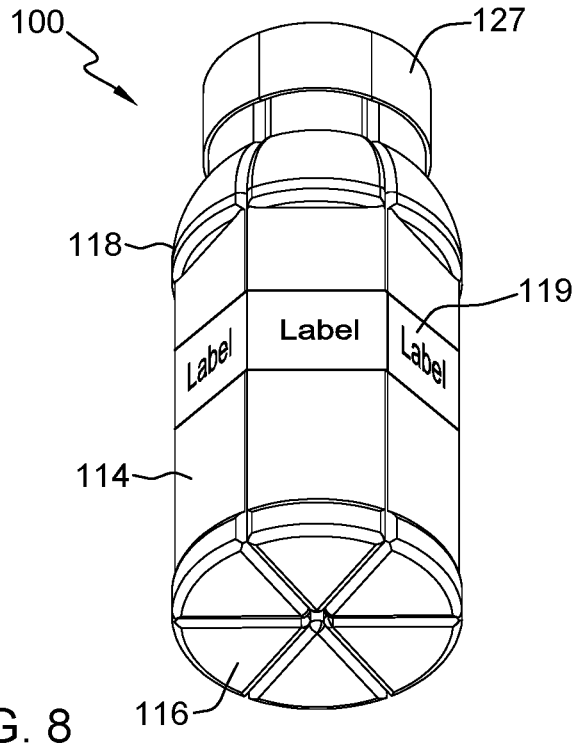

For example, FIGS. 1 and 2 illustrate initial rolling of the individual containers 110, FIGS. 3 and 4 illustrate more rolling, and FIGS. 5 and 6 illustrate even more rolling, while FIGS. 7 and 8 illustrate a completely rolled multi-compartment container 118. The rolled-up state occurs when two exterior walls 114 of adjacent ones of the individual containers 110 fold relative to one another along one of the wall edges 111. FIG. 8 illustrates the alternative where an adhesive sheet 119 (a label) is attached to discontinuous (physically separate) individual containers 110 to join the individual containers 110 together, and where the adhesive sheet 119 acts as the joint 111 between each of the individual containers 110. In other embodiments, the individual containers 110 can be formed as a single continuous series of connected individual containers 110 in a mold or other similar process, or individually produced individual containers 110 can be glued or bonded together.

As shown in the drawings, each of the individual containers 110 has two flat interior walls 112 that will contact interior walls 112 of adjacent containers 110 when the containers are rolled together. Additionally, the individual containers 110 include an exterior wall 114 and a triangular or pie-piece shaped bottom 116. The exterior walls 114 can be curved, flat, or can have curved or flat sections, depending upon styling choice. While the interior walls 112 should be flat, the exterior walls 114 can have any shape.

With regard to the individual caps 120, each of the individual caps 120 has a top member 122 and a side member 126, perpendicular to the top member 122, that join to form a corner 121 (FIG. 5). The upper surface of the top member 122 comes to a point opposite the corner 121 where the side member 126 joins the top member 122. Further, the top member 122 and the side member 126 form the exterior of the completed cap when the individual containers 110 are rolled together. The side member 126 has a curved surface, such that the side members 126 of the individual caps 120 form a rounded ring when the individual containers 110 are rolled together (and all corners 121 come together to form a circle in the completed cap).

Figure 9:
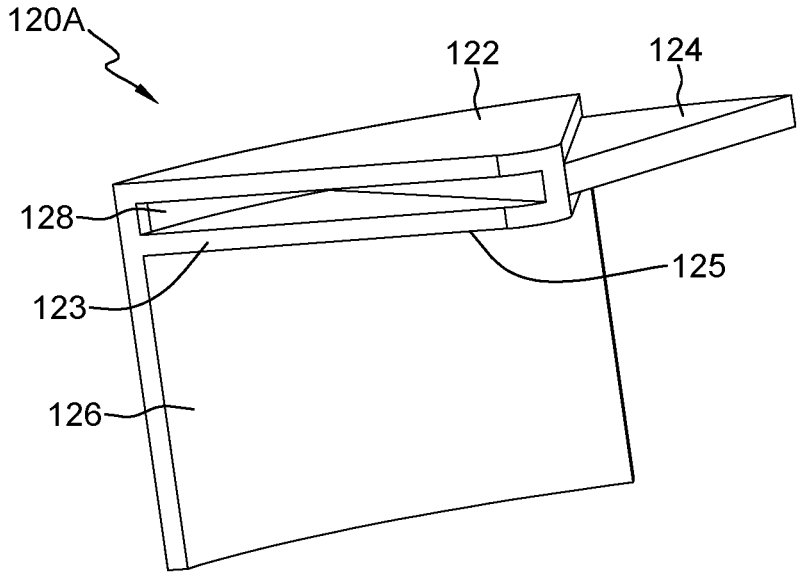
FIGS. 9-12 are perspective drawings illustrating specific aspects of caps herein.

As shown in greater detail in FIGS. 9-12, each of the individual caps 120 includes a projection 124 (which in this embodiment is a wing) and a triangular recess 128 positioned to join corresponding projections 124 and recesses 128 of adjacent individual caps 120. FIG. 9 illustrates one of the individual caps (which is designated 120A). As shown, the projection 124 (which is fixed) extends from the top member 122. Additionally, the recess 128 is formed between the top member 122 and a parallel similarly shaped lower member 123. The space between the top member 122 and the lower member 123 has the same shape as the projection 124, but is slightly (e.g., 5%, 10%, 15%, etc.) larger, to accommodate the projection 124.

Figure 10:
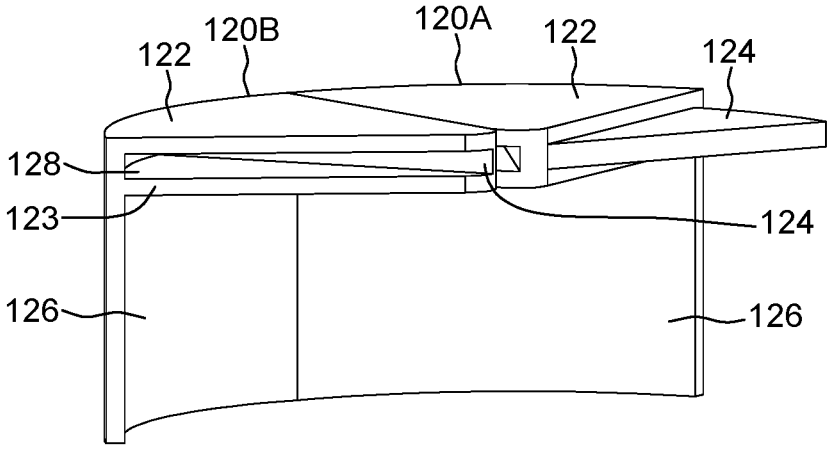
Figure 11:
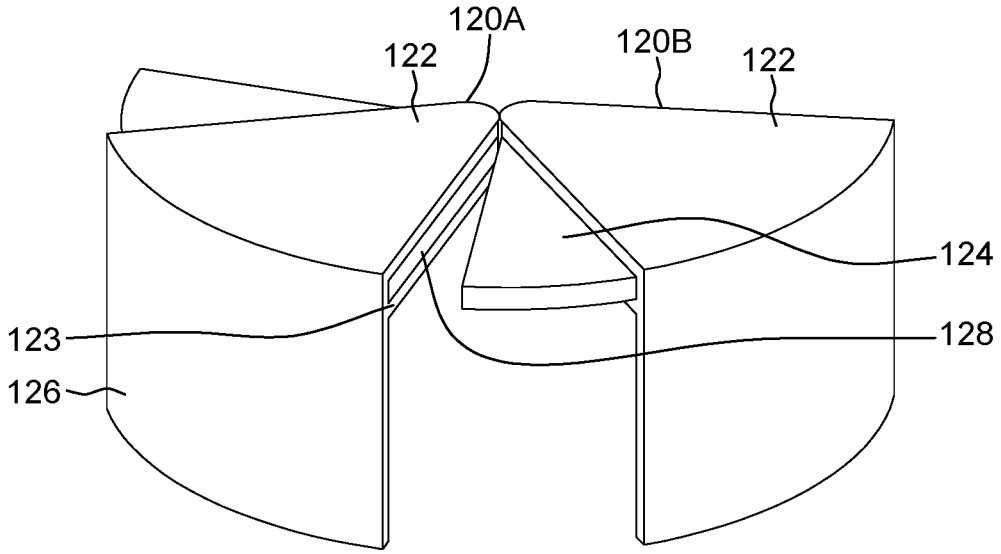
Figure 12:
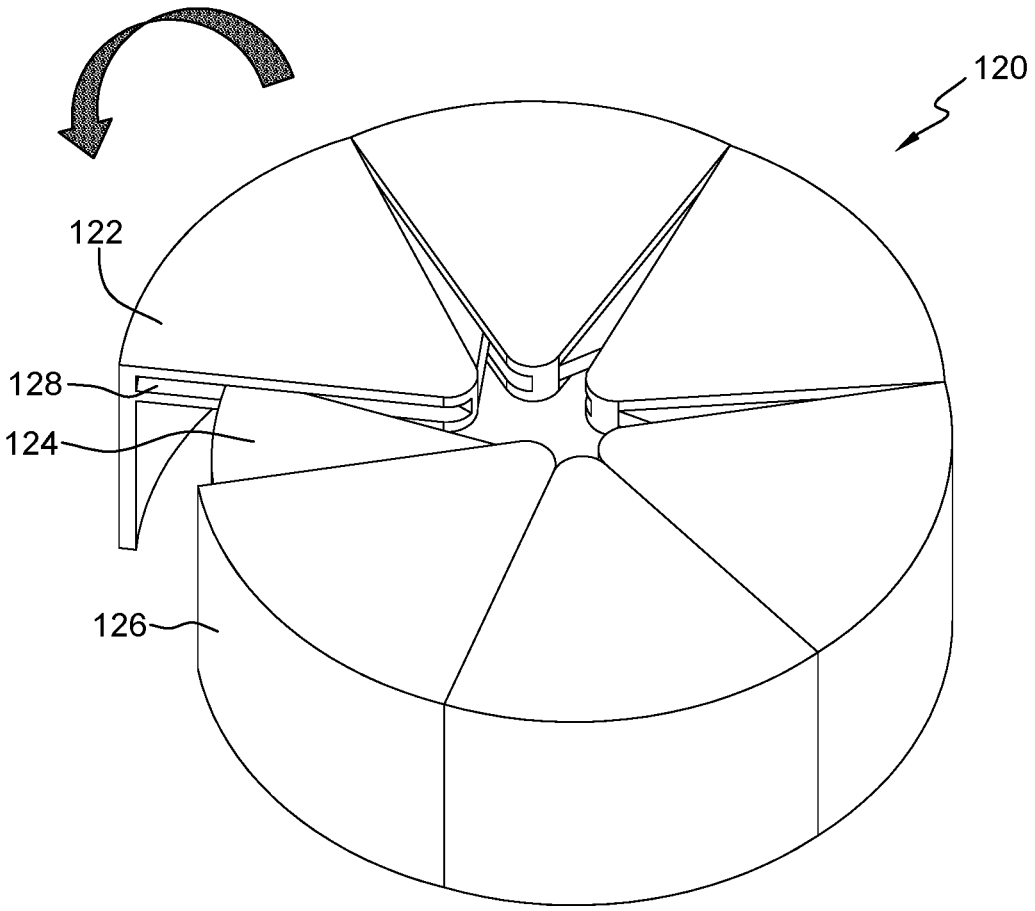

FIGS. 10 and 11 are perspective drawings that show how the projections 124 of individual cap 120B fits in the recess 128 of the adjacent individual cap 120A. Thus, as shown, the projection 124 and the recess 128 of the individual caps 120A-120B connect the individual caps 120 together. As shown in FIG. 12, this eventually forms a complete cap when the individual containers 110 are fully rolled together.

Figure 13:
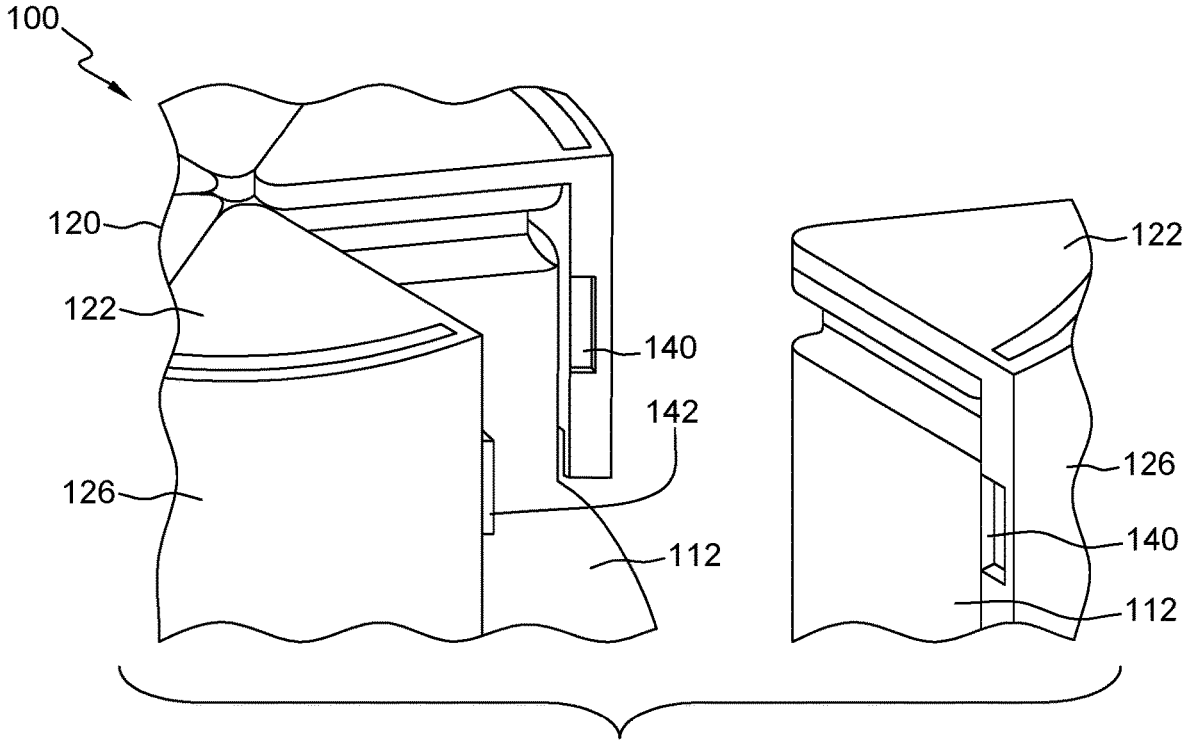
FIGS. 13-15 are perspective drawings illustrating different projections and recesses of devices herein.
Figure 14:
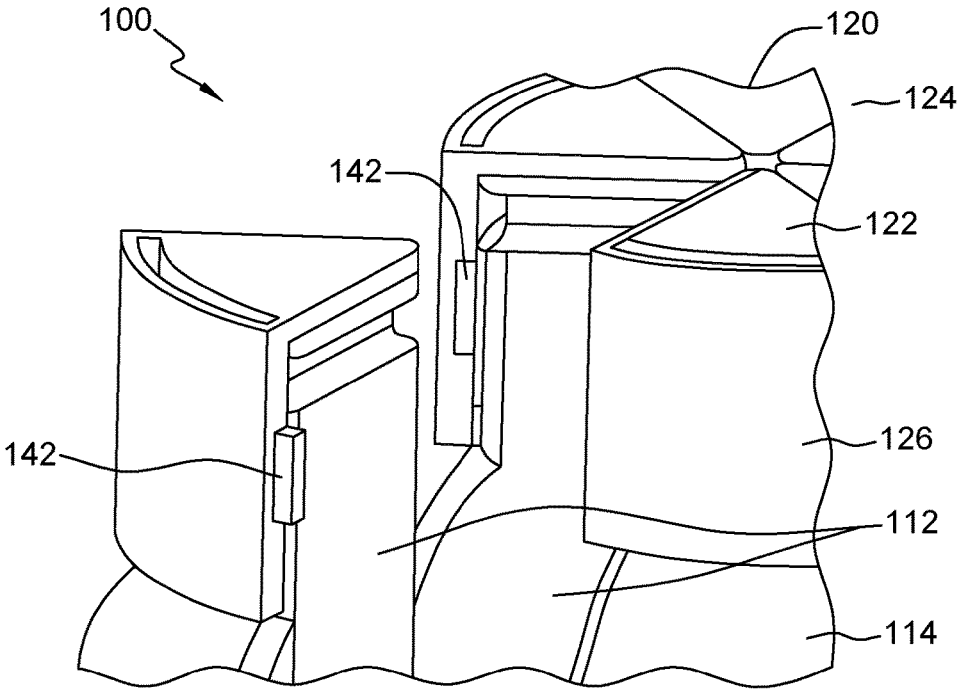
Figure 15:
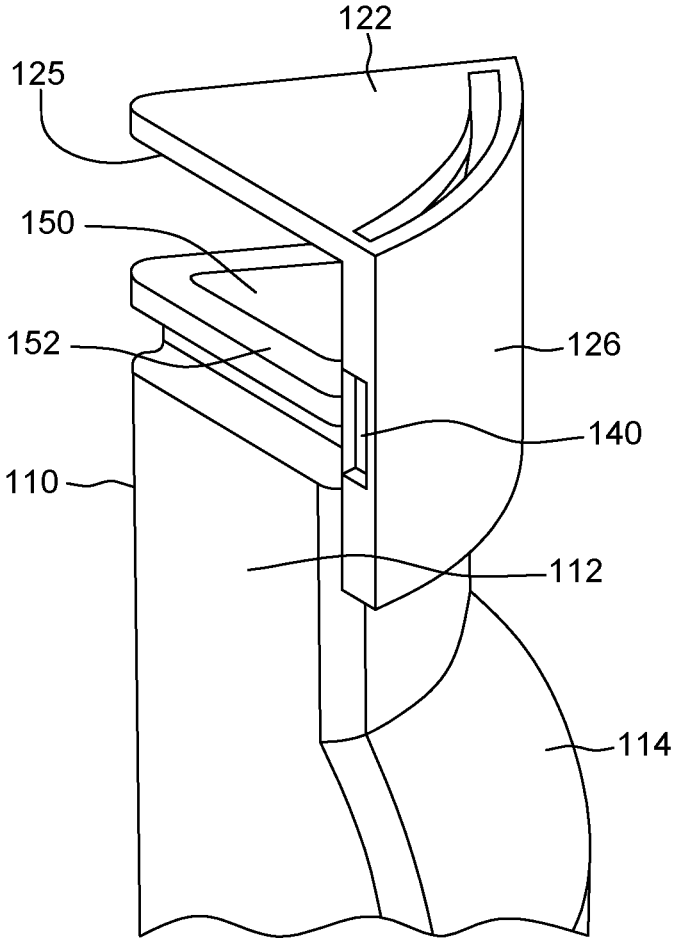

While the projection 124 shown above have a wing shape, the projections 124 can be other shapes, such as a tab 142 that fits into a slot 140, as shown in FIGS. 13-15. The tab 142 can be a rectangular cuboid or prism, while the wing 124 can be a triangular wing (e.g., delta wing) and the recesses 128, 140 have corresponding shapes. Also, the surfaces of such projection 124, 142 are shaped and sized to press tightly against the walls of the recess 128, 140 when the individual containers 110 are rolled together; and, thus, friction between the projections 124, 142 and the recesses 128, 140 prevents the completed cap 127 from unrolling. In other words, the projections 124, 142 can optionally fit sufficiently tightly within the recesses 128, 140 to require an amount of force to slightly deform the projections/recesses as they are joined, and thereby cause the projections/recesses to "click" or "snap" together with moderate force, which locks the projections 124/142 within the recesses 128, 140.

FIG. 15 also shows that the individual containers 110 have a container opening 150 and a top edge 152 that defines the container opening 150. Correspondingly, the individual caps 120 have a bottom surface 125 (see FIGS. 9, 15, and 19) that contacts the top edge 152 and seals the container opening 150 to form a watertight and airtight seal. The container opening 150 can be sealed with vacuum, an adhesive, using plastic fusing, etc. The watertight and airtight individual containers 110 prevents contents (e.g., liquid material, granular or powdered dry material, etc.) in one container 110 from being mixed with another container 110, until all caps 120 are removed simultaneously (which allows contents from all containers 110 to be mixed).

In the previous portions of this disclosure, the openings 150 have been described as fill/dispense openings, meaning that the openings 150 can be used to fill the individual containers 110 with different materials, and/or can be used for dispensing the contents from the individual containers 110. Thus, when the caps 120 are not in place, this allows the contents to be placed, poured, pumped, injected, etc., into the individual containers 110 through the fill/dispense openings 150 (after which the caps 120 are positioned to seal the openings 150).

Alternatively, various different injection processes can be utilized to inject different materials into the different individual containers. For example, the container structure 100 can be made of a somewhat flexible material that can be self-sealing if a small enough injection hole is utilized to inject the material. Alternatively, the injection process can be combined with a heating process that re-melts the material of the container structure 100, thereby sealing any injection holes as they are made. Additionally, those ordinarily skilled in the art we understand that many other types of self-sealing injection methodologies can be utilized with the structures disclosed.

In an alternative structure that aids in the filling of the individual containers 110, the exterior wall 114 can comprise a flap that can be open to allow the different materials to be inserted, placed, poured, pumped, injected, etc., into the individual containers 110. After the material is inserted into the individual containers, the exterior wall 114 is sealed to the other walls to again create the watertight and airtight sealed individual containers 110 that are described above.

While a few exemplary methodologies and structures for filling the individual containers 110 are described above, those ordinarily skilled in the art would understand that many other methodologies could be utilized to fill the individual containers with different materials. Further, these materials can be any form of materials, liquids, solids, crystalline materials, powdered materials, liquids containing solids, pressurize materials, carbonated materials, etc.

Figure 16:
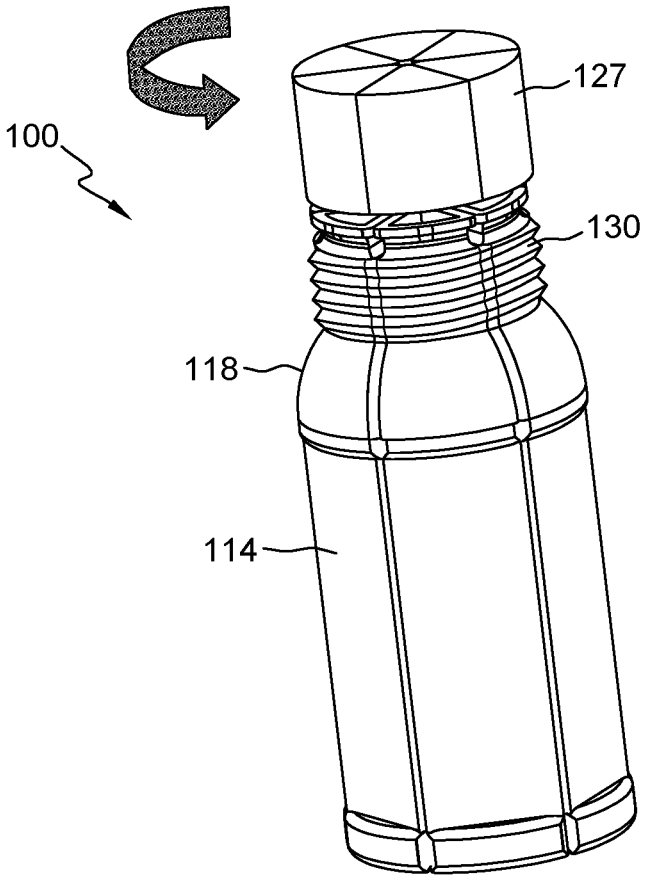
FIG. 16 is a perspective drawing illustrating cap removal from a fully rolled device herein.
Figure 17:
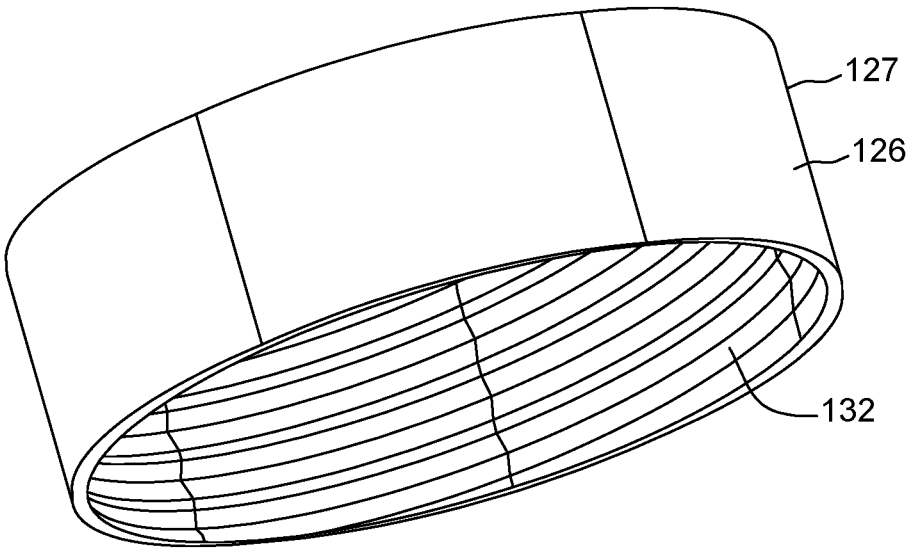
FIG. 17 is a perspective drawing illustrating a complete cap herein.
Figure 18:
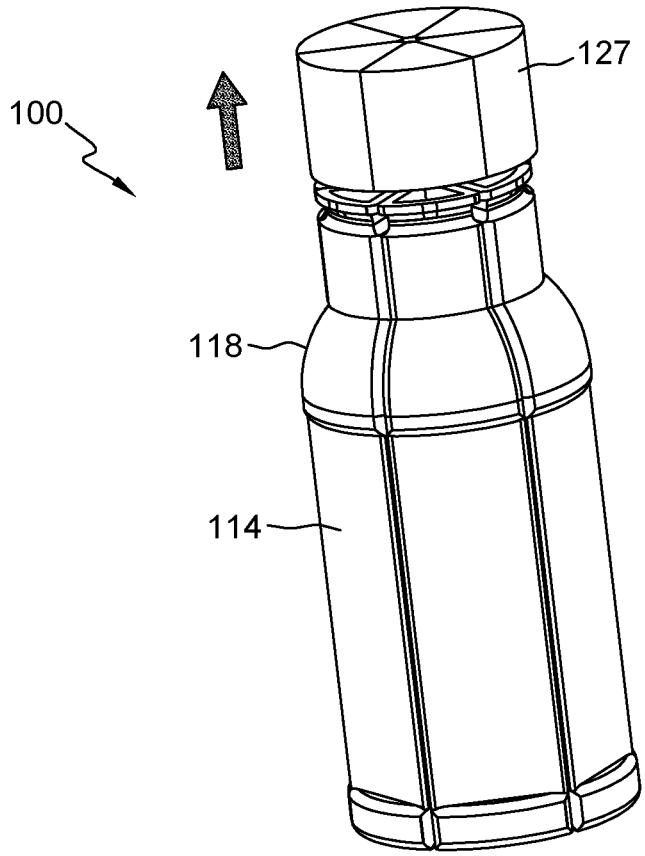
FIG. 18 is a perspective drawing illustrating cap removal from a fully rolled device herein.
Figure 19:
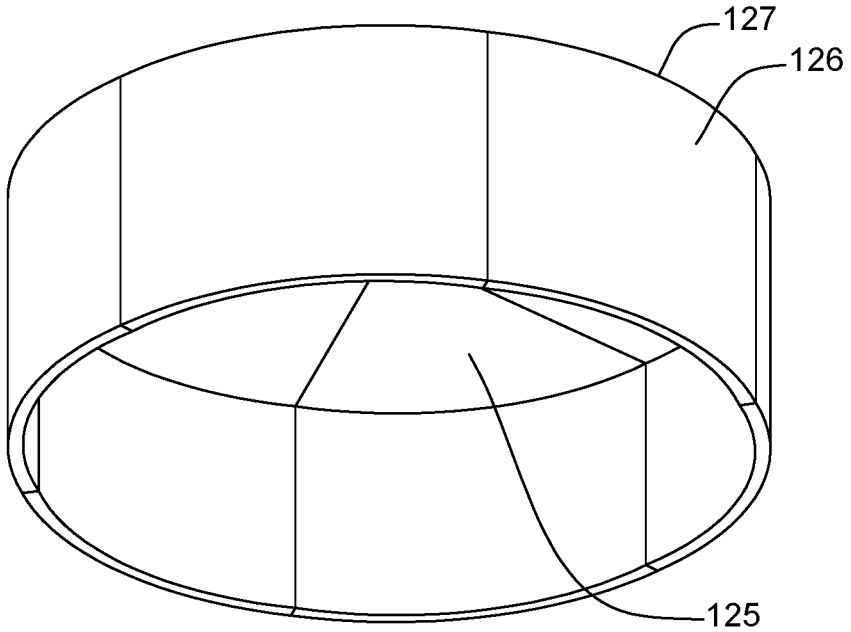
FIG. 19 is a perspective drawing illustrating a complete cap herein.

As shown in FIGS. 16-17, the complete multi-compartment container 118 and the complete cap 127 can optionally include complementary threading 130, 132, making the complete cap 127 capable of being unscrewed from the complete multi-compartment container 118, to simultaneously separate all of the individual caps 120 that form the complete cap 127 from all of the individual containers 110 that form the complete multi-compartment container. As shown in FIGS. 18-19, in other embodiments, no threading is included on the completed container 118 or completed cap 127, allowing all caps 120 to be simultaneously pulled off the individual containers 110 in one motion.

Thus, as shown in the drawings, the user can grab or pinch the overall completed cap structure 127 (created by the combination of the individual caps 120 in the rolled-up structure) using their fingers or the palm on their hand, allowing the user to simultaneously grasp all individual caps 120 and simultaneously remove all individual caps 120 from the rolled-up structure 118 in one twisting, pulling, cutting, and/or tearing user motion (FIG. 16 shows a twisting motion using a block arrow, while FIG. 18 shows a pulling or tearing motion using a block arrow).

Figure 20:
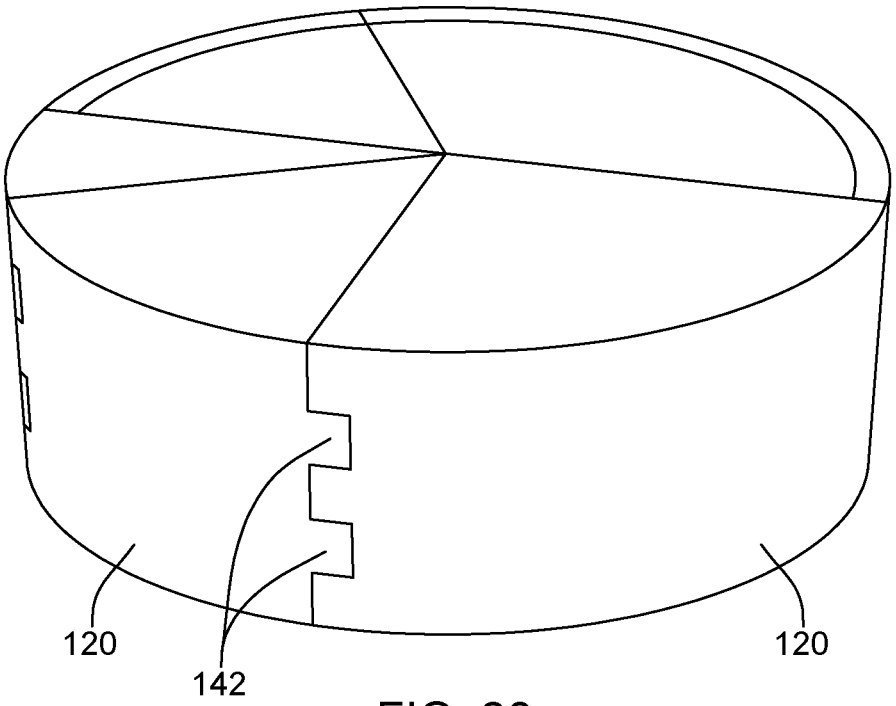
FIGS. 20-21 are perspective drawings illustrating multiple projections and recesses on each cap in devices herein.
Figure 21:
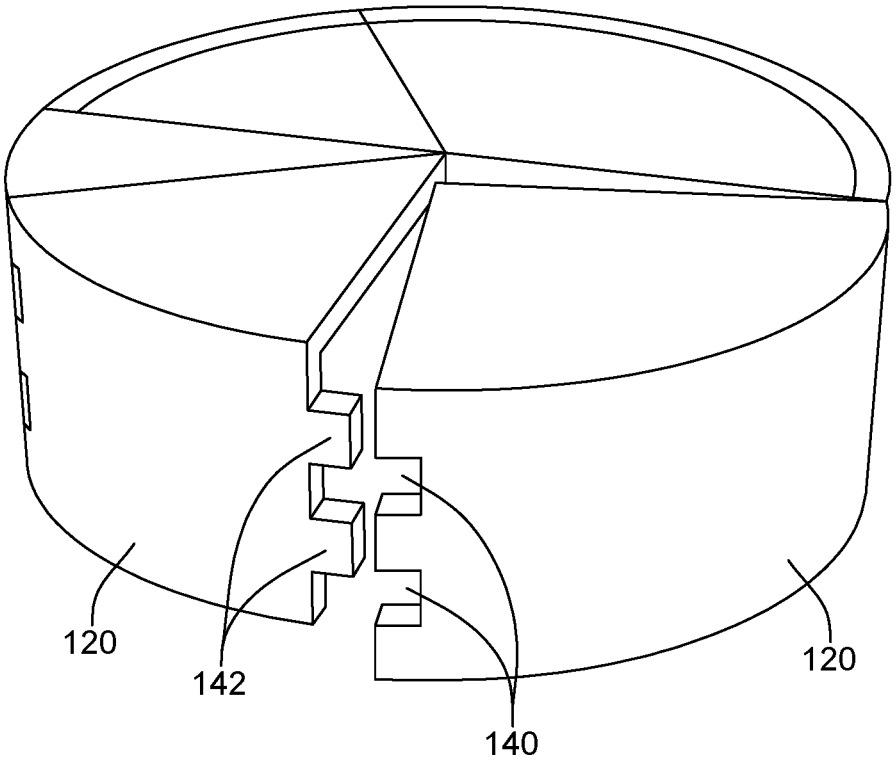

Also, as shown in FIGS. 20-21, each individual cap 120 can include multiple projections (that are shown as exemplary tabs 142 in FIGS. 20-21) that can be the same or different from one another (e.g., can be tabs 142, wings 124, etc., any combination thereof, etc.) and corresponding recesses (that are shown as exemplary slots 140 in FIGS. 20-21). The number of recesses 140 matches the number of projections 142 and, correspondingly, the recess 140 can comprises one or more recesses 128, slots 140, etc., any combination thereof, etc.). The recesses 128, 140 are shaped to receive and accommodate the projections 124, 142 by having matching sizes, locations, shapes, etc., as shown in FIGS. 20-21. Note also that FIGS. 20-21 illustrate that the caps 120 can be different pie-shaped sizes allowing the individual containers 110 to be triangular different sizes, so as to accommodate different relative quantities of a drink product.

Further, the number and/or cross-sectional size of individual containers 110 that are included within a single container structure 118 may be subject to the usage of the container. If, for example, a user-consumable drink that contains three distinct substances (e.g., water in one individual container, powered flavoring in one individual container, and sugar in one individual container) may only include three individual containers (if each container has sufficient volume to hold a prescribed quantity of material), which would result in a somewhat triangular-shaped container when rolled-up. Some of the individual containers can contain the same material, depending upon quantity requirements. Thus, those skilled in the art would understand that the rolled-up container structure herein can contain as many sides as there are individual containers and can be triangular, square, pentagonal, hexagonal, etc., and the number of individual containers may depend upon how many different materials the container structure 100 maintains.

All structures described herein can be made of any material capable of forming a watertight or airtight container, and such structures can be formed using any manufacturing process, whether currently known or developed in the future. For example, the container structures described herein can be formed of plastics, glasses, metals, alloys, rubbers, etc., or any combinations of such materials; and the structures herein can be fully (or have sections that are) transparent, translucent, non-transparent, etc. The container structures herein can be made using any manufacturing technique including, but not limited to injection molding, extrusion molding, stamping, patterning, lithography, material patterning/cutting/shaping/grinding, component assembly, etc. Further, some portions of the individual containers mentioned herein can be made of different materials than other portions of the individual containers or the entire container structure can be made of a single uniform material, depending upon the use of the container structure. Additional, the individual containers herein can be one-time-use individual containers, or can be reusable.

Therefore, the material makeup, appearance, size, shapes, etc., of the structures described herein can vary for different uses, so long as the flat base walls can be folded along the joints to allow the structure to be rolled-up from a flat state to a rolled-up state, where all the individual caps and openings are positioned adjacent one another when the structure is in the rolled-up state.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

individual containers shaped to fit together; and individual caps attachable to each of the individual containers, wherein each of the individual containers is connected to at least one other container of the individual containers by connections, wherein the connections between the individual containers permit the individual containers to be rolled together to form a complete multi-compartment container, wherein each of the individual caps includes a projection and a recess positioned to join corresponding projections and recesses of adjacent individual caps, wherein the projection and the recess of the individual caps connect the individual caps together to form a complete cap when the individual containers are rolled together, and wherein the complete multi-compartment container and the complete cap include complementary threading.

2. The apparatus of claim 1, wherein the individual caps comprise a top member and a side member perpendicular to the top member, and wherein the top member has a point opposite where the side member joins the top member, and wherein the top member and the side member form an exterior of the completed cap when the individual containers are rolled together.

3. The apparatus of claim 2, wherein the side member has a curved surface, such that the side member of the individual caps form a rounded ring when the individual containers are rolled together.

4. The apparatus of claim 1, wherein the complementary threading makes the complete cap capable of being unscrewed from the complete multi-compartment container to simultaneously separate all of the individual caps that form the complete cap from all of the individual containers that form the complete multi-compartment container.

5. The apparatus of claim 1, wherein the individual containers have a container opening and a top edge that defines the container opening, and wherein the individual caps have a bottom surface that contacts the top edge and seals the container opening.

6. An apparatus comprising:

individual containers shaped to fit together; and individual caps attachable to each of the individual containers, wherein each of the individual containers is connected to at least one other container of the individual containers by connections, wherein the connections between the individual containers permit the individual containers to be rolled together to form a complete multi-compartment container, wherein each of the individual caps includes a projection and a recess positioned to join corresponding projections and recesses of adjacent individual caps, wherein the projection and the recess of the individual caps connect the individual caps together to form a complete cap when the individual containers are rolled together, wherein the projection comprises at least one of a tab and a wing, wherein the recess comprises at least one slot shaped to receive and accommodate the tab or the wing, and wherein the projection is shaped to press against walls of the recess when the individual containers are rolled together, preventing the completed cap from unrolling.

7. The apparatus of claim 6, wherein the tab comprises a rectangular cuboid and the wing comprises a triangular wing.

8. An apparatus comprising:

pie-piece shaped individual containers shaped to fit together; and pie-piece shaped individual caps attachable to each of the individual containers, wherein each of the individual containers is connected to at least one other container of the individual containers by connections, wherein the connections between the individual containers permit the individual containers to be rolled together to form a complete multi-compartment container, wherein each of the individual caps includes a projection and a recess positioned to join corresponding projections and recesses of adjacent individual caps, wherein the projection and the recess of the individual caps connect the individual caps together to form a complete cap when the individual containers are rolled together, and wherein the complete multi-compartment container and the complete cap include complementary threading.

9. The apparatus of claim 8, wherein the individual caps comprise a top member and a side member perpendicular to the top member, and wherein the top member has a point opposite where the side member joins the top member, and wherein the top member and the side member form an exterior of the completed cap when the individual containers are rolled together.

10. The apparatus of claim 9, wherein the side member has a curved surface, such that the side member of the individual caps form a rounded ring when the individual containers are rolled together.

11. The apparatus of claim 8, wherein the complementary threading makes the complete cap capable of being unscrewed from the complete multi-compartment container to simultaneously separate all of the individual caps that form the complete cap from all of the individual containers that form the complete multi-compartment container.

12. The apparatus of claim 8, wherein the individual containers have a container opening and a top edge that defines the container opening, and wherein the individual caps have a bottom surface that contacts the top edge and seals the container opening.

13. An apparatus comprising:

pie-piece shaped individual containers shaped to fit together; and pie-piece shaped individual caps attachable to each of the individual containers, wherein each of the individual containers has the same size and shape and is connected to at least one other container of the individual containers by connections, wherein the connections between the individual containers permit the individual containers to be rolled together to form a complete multi-compartment container, wherein each of the individual caps includes a projection and a recess positioned to join corresponding projections and recesses of adjacent individual caps, wherein the projection and the recess of the individual caps connect the individual caps together to form a complete cap when the individual containers are rolled together, wherein the projection comprises at least one of a tab and a wing, wherein the recess comprises at least one slot shaped to receive and accommodate the tab or the wing, and wherein the projection is shaped to press against walls of the recess when the individual containers are rolled together, preventing the completed cap from unrolling.

14. The apparatus of claim 13, wherein the tab comprises a rectangular cuboid and the wing comprises a triangular wing.

15. A cap apparatus comprising:

individual caps attachable to individual containers, wherein the individual containers are shaped to fit together, wherein each of the individual containers is connected to at least one other container of the individual containers by connections, wherein the connections between the individual containers permit the individual containers to be rolled together to form a complete multi-compartment container, wherein each of the individual caps includes a projection and a recess positioned to join corresponding projections and recesses of adjacent individual caps, wherein the projection and the recess of the individual caps connect the individual caps together to form a complete cap when the individual containers are rolled together, and wherein the complete multi-compartment container and the complete cap include complementary threading.

16. The cap apparatus of claim 15, wherein the individual caps comprise a top member and a side member perpendicular to the top member, and wherein the top member has a point opposite where the side member joins the top member, and wherein the top member and the side member form an exterior of the completed cap when the individual containers are rolled together.

17. The cap apparatus of claim 16, wherein the side member has a curved surface, such that the side member of the individual caps form a rounded ring when the individual containers are rolled together.

18. The cap apparatus of claim 15, wherein the complementary threading makes the complete cap capable of being unscrewed from the complete multi-compartment container to simultaneously separate all of the individual caps that form the complete cap from all of the individual containers that form the complete multi-compartment container.

19. A cap apparatus comprising:

individual caps attachable to individual containers, wherein the individual containers are shaped to fit together, wherein each of the individual containers is connected to at least one other container of the individual containers by connections, wherein the connections between the individual containers permit the individual containers to be rolled together to form a complete multi-compartment container, wherein each of the individual caps includes a projection and a recess positioned to join corresponding projections and recesses of adjacent individual caps, wherein the projection and the recess of the individual caps connect the individual caps together to form a complete cap when the individual containers are rolled together, wherein the projection comprises at least one of a tab and a wing, wherein the recess comprises at least one slot shaped to receive and accommodate the tab or the wing, and wherein the projection is shaped to press against walls of the recess when the individual containers are rolled together, preventing the completed cap from unrolling.

20. The cap apparatus of claim 19, wherein the tab comprises a rectangular cuboid and the wing comprises a triangular wing.

* * * * *